US009543095B2

(12) United States Patent
Kaneko et al.

(10) Patent No.: US 9,543,095 B2
(45) Date of Patent: Jan. 10, 2017

(54) GAS CIRCUIT BREAKER

(71) Applicant: Hitachi, Ltd., Chiyoda-ku, Tokyo (JP)

(72) Inventors: Yuji Kaneko, Tokyo (JP); Noriyuki Yaginuma, Tokyo (JP); Daisuke Nomura, Tokyo (JP); Makoto Hirose, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/768,691

(22) PCT Filed: Feb. 3, 2014

(86) PCT No.: PCT/JP2014/052388

§ 371 (c)(1),
(2) Date: Aug. 18, 2015

(87) PCT Pub. No.: WO2014/136513

PCT Pub. Date: Sep. 12, 2014

(65) Prior Publication Data

US 2016/0005559 A1 Jan. 7, 2016

(30) Foreign Application Priority Data

Mar. 8, 2013 (JP) ..... 2013-046093

(51) Int. Cl.
*H01H 33/04* (2006.01)
*H01H 33/70* (2006.01)
(Continued)

(52) U.S. Cl.
CPC ..... *H01H 33/04* (2013.01); *H01H 33/56* (2013.01); *H01H 33/64* (2013.01); *H01H 33/70* (2013.01);
(Continued)

(58) Field of Classification Search
CPC ..... H01H 33/04; H01H 33/56; H01H 33/64; H01H 33/70; H01H 33/7061; H01H 33/91
(Continued)

(56) References Cited

U.S. PATENT DOCUMENTS 4,939,322 A * 7/1990 Kashimura ..... H01H 33/91 218/62
5,510,591 A * 4/1996 Tremblay ..... H01H 33/006 218/43
(Continued)

FOREIGN PATENT DOCUMENTS

CN 1438665 A 8/2003
CN 101111915 A 1/2008
(Continued)

OTHER PUBLICATIONS

International Search Report (PCT/ISA/210) dated Mar. 18, 2014, with English translation (Four (4) pages).
(Continued)

*Primary Examiner* — Truc Nguyen
*Assistant Examiner* — William Bolton
(74) *Attorney, Agent, or Firm* — Crowell & Moring LLP

(57) ABSTRACT

A gas circuit breaker is configured by comprising a tank filled with arc extinguishing gas, a pair of fixed side arc contact and moving side arc contact in the tank, a puffer chamber formed with a puffer cylinder including the moving side arc contact at its end and a fixed piston, and an insulating nozzle, attached to the end of the puffer cylinder, surrounding the moving side arc contact, that forms a flow channel to guide arc extinguishing gas from the puffer chamber to the contacts. A puffer cylinder 104 has a cylindrical member 104*a* at a breaker side end, an end of the insulating nozzle 101 is provided in the cylindrical member 104*a*. And the gas circuit breaker is configured by further
(Continued)

comprising a hollow moving side main contact 102 at a breaker side end of the cylindrical member 104*a*, a pressing metal fitting 103 to engage an insulating nozzle 101 in the hollow part of the moving side main contact 102.

10 Claims, 10 Drawing Sheets

(51) Int. Cl.
*H01H 33/91* (2006.01)
*H01H 33/56* (2006.01)
*H01H 33/64* (2006.01)

(52) U.S. Cl.
CPC ..... *H01H 33/7061* (2013.01); *H01H 33/91* (2013.01); *H01H 33/7023* (2013.01)

(58) Field of Classification Search
USPC ..... 218/43, 57, 59–61, 63
See application file for complete search history.

(56) References Cited

U.S. PATENT DOCUMENTS

| | | | | |
|---|---|---|---|---|
| 5,585,610 | A * | 12/1996 | Meyer | H01H 33/7061 218/57 |
| 6,040,970 | A | 3/2000 | Lehmann et al. | |
| 6,365,863 | B1 * | 4/2002 | Marin | H01H 33/42 218/43 |
| 6,696,657 | B2 * | 2/2004 | Hirose | H01H 33/7076 218/63 |
| 2003/0094437 | A1 | 5/2003 | Hirose et al. | |
| 2007/0295693 | A1 | 12/2007 | Saxl et al. | |

FOREIGN PATENT DOCUMENTS

| | | | |
|---|---|---|---|
| JP | 4-63523 | U | 5/1992 |
| JP | 8-111151 | A | 4/1996 |
| JP | 9-97543 | A | 4/1997 |
| JP | 10-003834 | | 1/1998 |
| JP | 2000-509544 | A | 7/2000 |
| JP | 2008-123761 | | 5/2008 |
| JP | 2008-529223 | A | 7/2008 |

OTHER PUBLICATIONS

Taiwanese Office Action dated Apr. 7, 2015, with English translation (Twelve (12) pages).
Korean Office Action issued in corresponding Korean Application No. 7010493 dated Jul. 8, 2016 with English translations (7 pages).
Chinese-language Office Action issued in counterpart Chinese Application No. 201480007321.2 dated Sep. 27, 2016 with partial English translation (6 pages).

* cited by examiner

GAS CIRCUIT BREAKER

TECHNICAL FIELD

The present invention relates to an electric-power gas circuit breaker using $SF_6$ gas as arc extinguishing gas, and more particularly, to a fixing structure for an insulating nozzle forming its arc extinguishing part.

BACKGROUND ART

In recent years, a circuit breaker with enlarged capacity is developed along with development of high-voltage and high-current electric power system. On the other hand, there are increasing needs for cost reduction and space saving by optimization of a breaker part structure. Accordingly, a circuit breaker in which puffer gas pressure is higher in comparison with conventional circuit breakers, typified by a small heat puffer type circuit breaker having excellent breaking performance, is being propagated.

Generally, in a breaker-part moving side structure of the gas circuit breaker including the heat puffer type circuit breaker, an insulating nozzle and a moving side main contact are provided on the breaker part side from a puffer cylinder part. The insulating nozzle is provided for the purpose of effectively blowing arc extinguishing gas to arc which occurs between moving side and fixed side arc contacts.

As a typical insulating nozzle fixing method, known is a structure where an outer peripheral part of a rear end of the insulating nozzle is cut in a screw, and is screwed with an inner peripheral screw part at the end of the puffer cylinder from the breaker part side, thus fixing is made.

In this fixing method, it is possible to simply perform attachment and centering work at the time of assembly. Further, upon nozzle change at the time of maintenance, it is possible to perform work from a manhole provided in the vicinity of the breaker part.

However, in accordance with increment in the above-described puffer gas pressure, a holding function with respect to the puffer gas pressure cannot be expected only with the screw fixing structure. Accordingly, the problem is that the potential of accident such as drop off of insulating nozzle upon breaking operation is high.

Regarding such problem, as shown in FIG. 1 of Patent Document 1, a structure to prevent drop off of the insulating nozzle is proposed. The insulating nozzle is engaged with the inner diameter side at the end of the puffer cylinder, and is held with a nozzle presser which also works as a moving side main contact.

In this structure, the insulating nozzle is firmly fixed in comparison with the above-described fixing structure with screw holding, and the drop off of the insulating nozzle due to gas pressure increasing is prevented.

CITATION LIST

Patent Document

Patent Document 1: Japanese Patent Application Laid-Open No. Hei 08-111151

SUMMARY OF THE INVENTION

Technical Problem

However, in this structure, when the nozzle is changed upon maintenance of the breaker part, it is necessary to remove the nozzle presser which also works as a moving side main contact. The structure has a problem in its maintenability since the number of work steps upon reassembling is increased.

The present invention has an object to provide a gas circuit breaker, using an insulating nozzle fixing structure with high reliability and maintenability, in which nozzle change can be performed with ease while drop off of the insulating nozzle is prevented.

Solution to the Problem

The present invention has been made in view of the above problem, and a gas circuit breaker is configured by comprising a tank filled with arc extinguishing gas, a pair of fixed side arc contact and moving side arc contact in the tank, a puffer chamber formed with a puffer cylinder including the moving side arc contact at its end and a fixed piston, and an insulating nozzle, attached to the end of the puffer cylinder, surrounding the moving side arc contact, that forms a flow channel to guide arc extinguishing gas from the puffer chamber to the contacts. The arc extinguishing gas in the puffer chamber is compressed in accordance with opening operation of the contacts and blown to arc between the contacts. The puffer cylinder has a cylindrical member at its breaker part side end. An end of the insulating nozzle is provided in the cylindrical member. And the gas circuit breaker is configured by further comprising a hollow moving side main contact at a breaker part side end of the cylindrical member, an engagement member that engages the insulating nozzle in a hollow part of the moving side main contact.

Advantageous Effects of the Invention

In the gas circuit breaker according to the present invention, by employing the above-described fixing structure, it is possible to perform nozzle change with ease while preventing drop off of the insulating nozzle. Further, it is possible to prevent misalignment of the breaker part since it is not necessary to remove the moving side main contact upon nozzle change. With this configuration, it is possible to provide a gas circuit breaker with high reliability and maintenability.

DESCRIPTION OF THE EMBODIMENTS

Hereinbelow, embodiments of the present invention will be described using the drawings. The following descriptions are merely examples of implementation, and not intended to limit the contents of the invention to the following detailed embodiments. The invention itself can be implemented in various embodiments in accordance with the contents described in the scope of claims.

Embodiment 1

Figure 2:
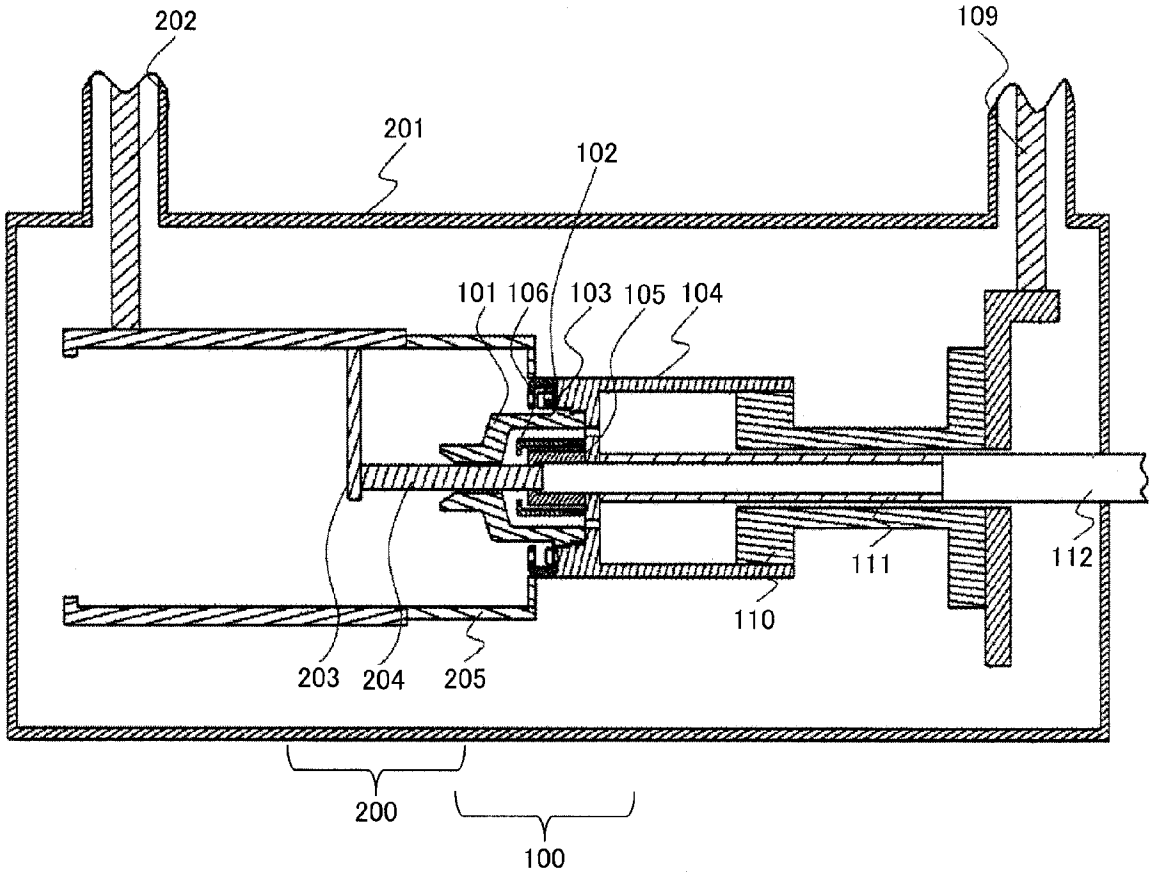
FIG. 2 is a cross-sectional diagram of a gas circuit breaker to which the insulating nozzle fixing structure according to the present invention is applied.

FIG. 2 shows the outlines of the inside of a gas circuit breaker configured with an insulating nozzle 101, a moving side main contact 102, and a pressing metal fitting 103, according to the present invention. The other constituent elements except for the insulating nozzle 101, the moving main contact 102, and the pressing metal fitting 103 are the same as the constituent elements of a conventional gas circuit breaker.

An insulating tank 201 is filled with insulating gas such as $SF_6$ gas, and a fixed side conductor 202 and a moving side conductor 109 are drawn in the tank. The fixed side conductor 202 is electrically connected to a fixed side arc contact base 203, a fixed side arc contact 204 and a fixed side main contact 205 configuring a fixed side breaker part 200.

The moving side conductor 109 is electrically connected to a moving side breaker part 100 via a puffer piston 110 and a puffer cylinder 104.

A puffer shaft 111 is coaxially provided inside the puffer cylinder 104. One end of the puffer shaft is fixed to the puffer cylinder 104. The other end of the puffer shaft 111 is connected to the insulating rod 112. With this configuration, a driving force from an operation unit (not shown) attached to the other end of the insulating rod 112 is transmitted to the moving side breaker part 100.

Figure 1:
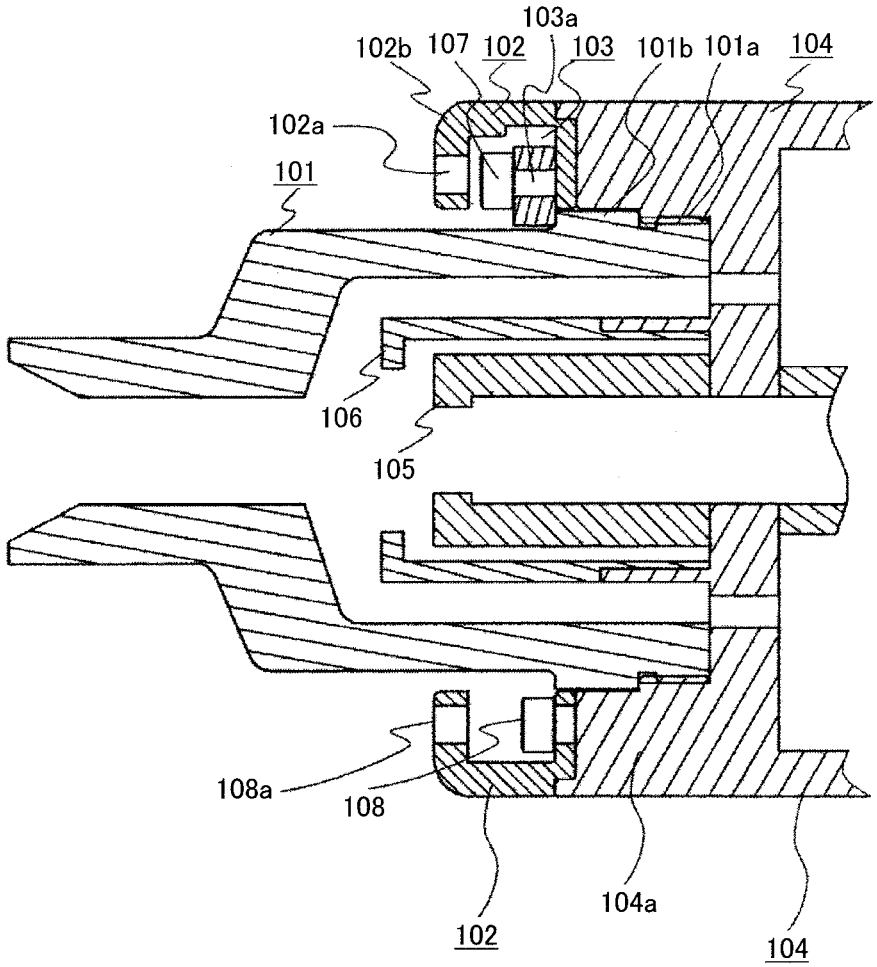
FIG. 1 is a cross-sectional diagram illustrating an insulating nozzle fixing structure according to an embodiment 1 of the present invention.

FIG. 1 is an enlarged diagram of the moving side breaker part 100 in FIG. 2. A moving side arc contact 105 is provided at the center of an end of the puffer cylinder 104. On an outer periphery of the moving side arc contact 105, an insulating cover 106, an insulating nozzle 101, and a moving side main contact 102 are respectively coaxially provided so as to surround the outer periphery of the moving side arc contact.

In FIG. 1, an end of the puffer cylinder 104 is projected in a cylindrical shape (hereinbelow, referred to as a "cylindrical member 104*a*"), and the moving side main contact 102 is fixed to the end with plural moving side main contact fixing bolts 108 (see FIG. 5).

The moving side main contact 102 has a hollow shape. A pressing metal fitting fixing bolt 107 and the moving side main contact fixing bolt 108 are fixed in this hollow member. The breaker part side end of the moving side main contact 102 is configured with a curved moving side main contact shield 102*b* for mitigation of an electric field. A pressing metal fitting regulating hole 102*a* to be described later, a fastening hole 107*a* for fastening the pressing metal fitting fixing bolt 107, and a fastening hole 108*a* for fastening the moving side main contact fixing bolt 108 are provided on the moving side main contact shield 102*b* (See FIG. 8).

As shown in FIG. 1, the insulating nozzle 101 is fitted in the cylindrical member 104*a*. The insulating nozzle screw member 101*a* is screwed with the cylindrical member 104*a*. The insulating nozzle 101 has an insulating nozzle large diameter member 101*b* in a position opposite to the end of the cylindrical member 104*a* (breaker part side end).

In consideration of thermal expansion upon occurrence of arc, the insulating nozzle large diameter member 101*b* is fitted in a position on an inner surface of the cylindrical member 104*a* of the puffer cylinder 104, with slight space between the large diameter member 101*b* and the inner surface.

Figure 5:
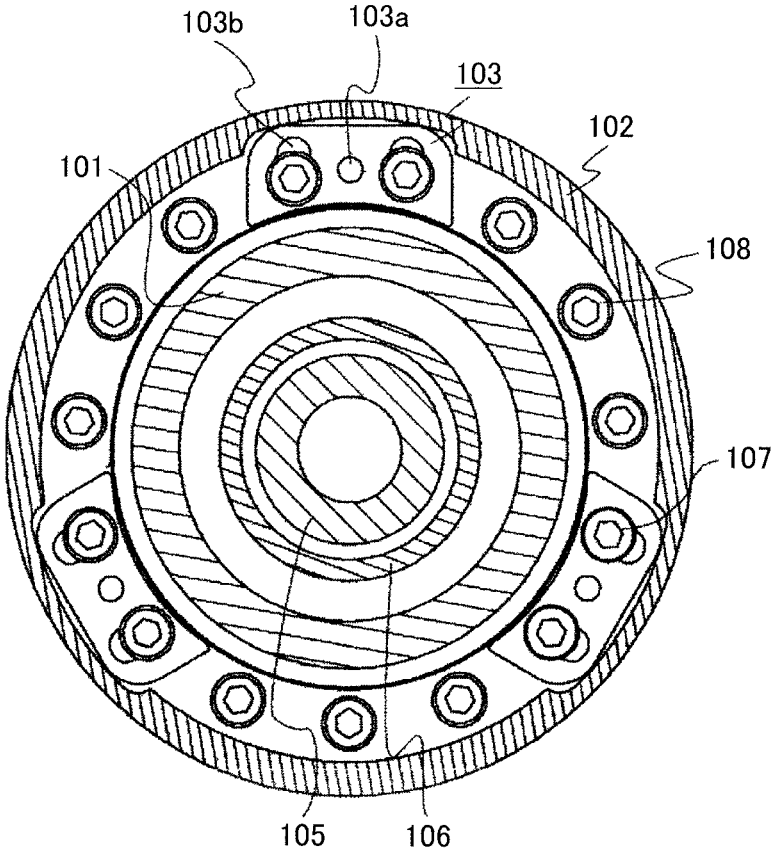
FIG. 5 is an A-A cross-sectional diagram in FIG. 4.

The pressing metal fitting 103 and the moving side main contact 102 are fastened with the pressing metal fitting fixing bolt 107 (see FIG. 5). With this configuration, as shown in FIG. 1, the insulating nozzle large diameter member 101*b* is engaged with the pressing metal fitting 103, and is fixed to an inner peripheral surface of the cylindrical member 104*a* of the puffer cylinder 104.

Figure 3:
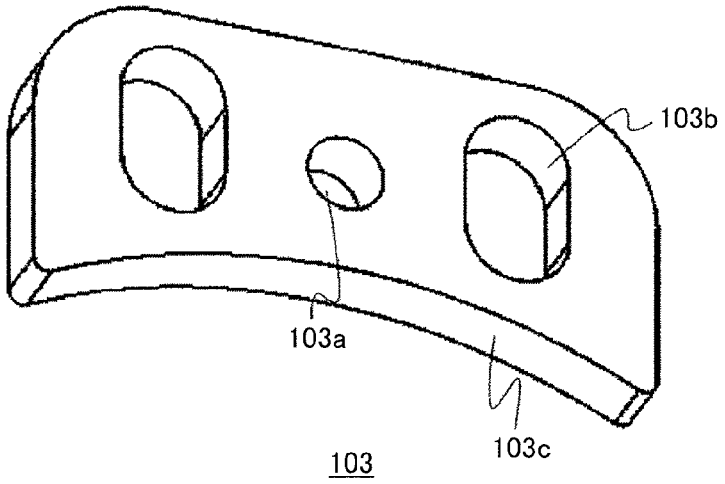
FIG. 3 is a perspective diagram illustrating a pressing metal fitting according to the embodiment 1 of the present invention.

FIG. 3 shows an example of the pressing metal fitting 103. The engagement member 103*c* to engage the insulating nozzle large diameter member 101*b* of the insulating nozzle 101 is configured in a curved shape with a curvature substantially the same as that of an outer periphery of the insulating nozzle 101. A pressing metal fitting positioning hole 103*a* is provided at substantially the center of the pressing metal fitting 103, and a screw engagement long hole 103*b* is provided at both ends of the pressing metal fitting positioning hole 103*a*.

The screw engagement long hole 103*b* is a long hole to adjust a fixing position of the pressing metal fitting 103 with respect to the insulating nozzle 101 in the hollow part of the moving side main contact 102, upon fixing, in a diameter direction of the insulating nozzle 101.

Figure 7:
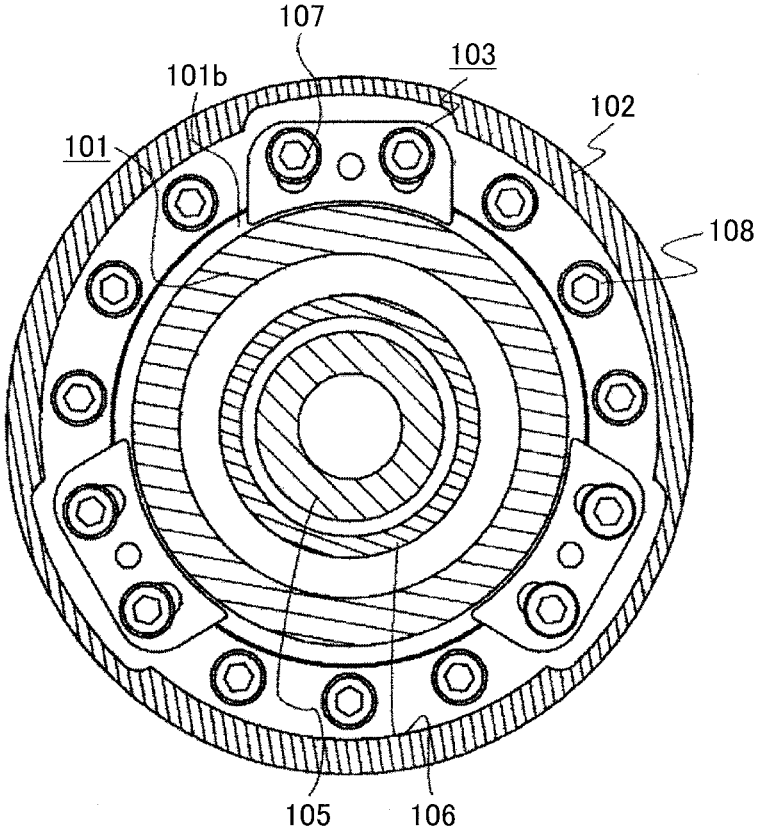
FIG. 7 is a B-B cross-sectional diagram in FIG. 6.

It is preferable that the pressing metal fitting 103 is configured with a high-strength steel product. The pressing metal fitting 103 is provided in plural positions along the outer periphery of the insulating nozzle 101 to have sufficient strength in correspondence with the size of the breaker part. As an example, as shown in FIG. 7, it may be configured such that the pressing metal fitting 103 is provided in three positions at equal intervals.

Next, a method of attaching the insulating nozzle 101 using the pressing metal fitting 103 according to the embodiment 1 will be described. First, the moving side main contact 102 is fixed to the end of the cylindrical member 104*a* with the fixing bolts 108 (see FIGS. 1 and 5), then the insulating nozzle 101 is screwed in the inner peripheral surface of the cylindrical member 104*a*, and the pressing metal fitting 103 is temporarily fixed with the pressing metal fitting fixing bolt 107 (see FIG. 5).

Figure 4:
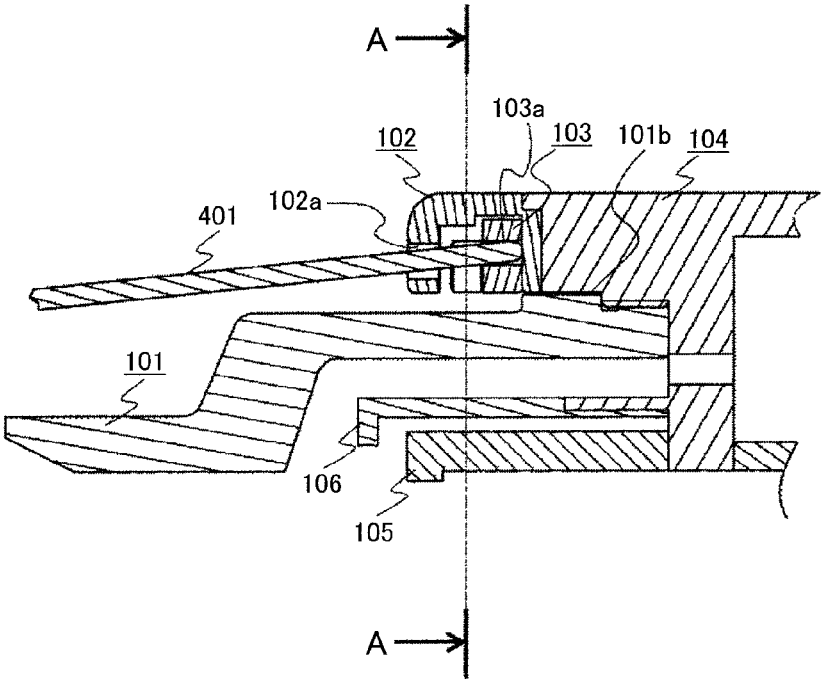
FIG. 4 is a cross-sectional diagram showing a procedure for attachment of the pressing metal fitting using a pressing metal fitting positioning jig according to the present invention, showing a status before the insulating nozzle is pressed with the pressing metal fitting.
Figure 6:
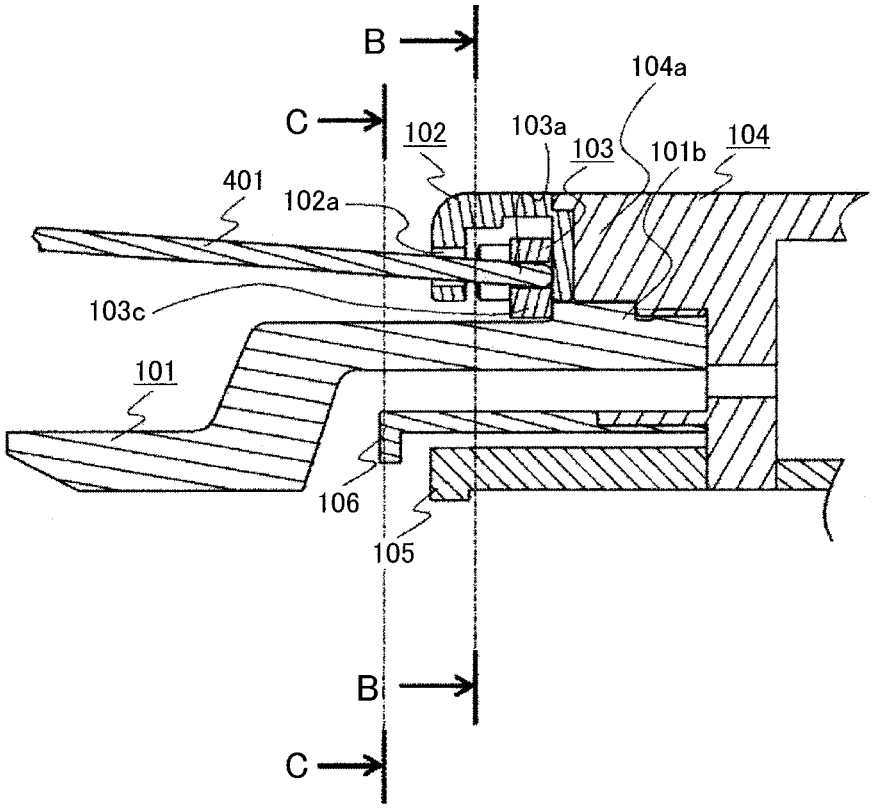
FIG. 6 is a cross-sectional diagram showing the procedure for attachment of the pressing metal fitting using the pressing metal fitting positioning jig according to the present invention, showing a status where the insulating nozzle has been pressed with the pressing metal fitting.
Figure 8:
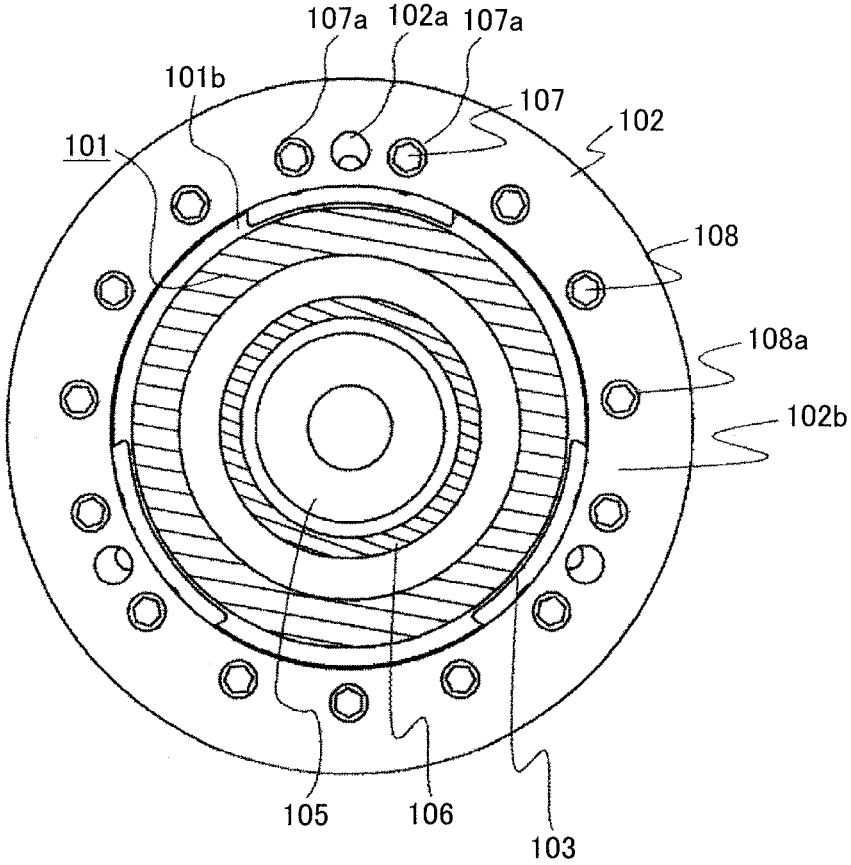
FIG. 8 is a C-C cross-sectional diagram in FIG. 6.

FIGS. 4 and 5 show a status before the pressing metal fitting 103 is engaged with the insulating nozzle large diameter member 101*b* of the insulating nozzle 101. FIGS. 6 and 7 show a status after the engagement. As shown in FIGS. 4 and 8, the pressing metal fitting regulating hole 102*a* is provided in plural positions at the breaker part side end of the moving side main contact 102. As shown in FIG. 4, the pressing metal fitting positioning jig 401 is inserted via the pressing metal fitting regulating hole 102*a* in the pressing metal fitting positioning hole 103*a*.

FIG. 5 shows a status of an A-A cross section in FIG. 4 viewed from the breaker part side. In this status, the pressing metal fitting fixing bolt 107 is temporarily fixed, and the position of the pressing metal fitting 103 is adjustable along a lengthwise direction of the screw engagement long hole 103*b*.

Next, as shown in FIG. 6, the position of the pressing metal fitting 103 is shifted with the pressing metal fitting regulating hole 102*a* as a fulcrum such that the engagement member 103*c* of the pressing metal fitting 103 is in contact with the outer periphery of the insulating nozzle 101. With this configuration, in the status where the insulating nozzle large diameter member 101*b* is engaged, the pressing metal fitting fixing bolt 107 is fastened.

The fastening of the pressing metal fitting fixing bolt 107 is performed from a gap between the insulating nozzle 101 and the moving main contact 102. To facilitate the fastening work, as described later, the fastening hole 107*a* (see FIG. 8) for fastening the pressing metal fitting fixing bolt 107 is provided in plural positions in the moving side main contact shield 102*b*, and the bolt 107 is fastened via the hole.

FIG. 8 is a C-C cross-sectional diagram in FIG. 6, showing a front side of the moving side main contact 102 viewed from the breaker part side. A fastening hole 108*a* for fastening the moving side main contact fixing bolt 108 from the breaker part side is provided in plural positions in a peripheral direction of the moving side main contact in the front side of the moving side main contact 102.

Further, a pressing metal fitting regulating hole 102*a* is provided in the same number of positions as that of the pressing metal fitting 103. The fastening hole 107*a* for fastening the pressing metal fitting fixing bolt 107 from the breaker part side is provided on the both sides of the pressing metal fitting regulating hole 102*a*. Note that in FIG. 8, the pressing metal fitting 103 is fixed inside the moving side main contact shield 102*b* and its major part is hidden with the shield 102*b*. Accordingly, only the end of the pressing metal fitting on the engagement member 103*c* side appears.

In FIG. 8, the moving side main contact fixing bolt 108 appears from the fastening hole 108*a* and the pressing metal fitting fixing bolt 107 appears from the fastening hole 107*a*. Actually, as described above, the moving side main contact fixing bolt 108 and the pressing metal fitting fixing bolt 107 are fixed in the hollow part of the moving side main contact 102 (see FIG. 1).

In this manner, as the pressing metal fitting fixing bolt 107 and the moving side main contact fixing bolt 108 are disposed inside the moving main side contact shield 102*b*, there is no fear that these bolts become vulnerable parts on the electric field. The configuration contributes to improvement in reliability.

As described above, the insulating nozzle 101 is engaged with the pressing metal fitting 103 and firmly fixed. In comparison with a conventional configuration where the insulating nozzle is fixed only by screwing, the possibility of drop off of the insulating nozzle is markedly reduced, and the reliability is improved.

When the insulating nozzle 101 is changed for maintenance of the breaker part, the insulating nozzle 101 is removed and a new insulating nozzle 101 is attached by reversely performing the above procedure.

According to the procedure, it is possible to change the insulating nozzle 101, without removing the moving side main contact 102, from a manhole for breaker part work generally provided in the vicinity of the breaker part. Accordingly, it is possible to markedly improve operability in comparison with the conventional work performed when the moving side main contact has been removed.

As shown in FIGS. 6 and 7, the moving side main contact 102 is fixed to the cylindrical member 104*a* at the end of the puffer cylinder 104 with the moving side main contact fixing bolt 108. Accordingly, when the insulating nozzle 101 is changed upon maintenance work, even though the pressing metal fitting fixing bolt 107 is removed, the moving side main contact fixing bolt 108 is still fixed. The work can be performed without any influence on the fixing of the moving side main contact 102. It is possible to prevent misalignment of the breaker part (the central axis of the moving side main contact is shifted from that of the fixed side main contact).

Figure 10:
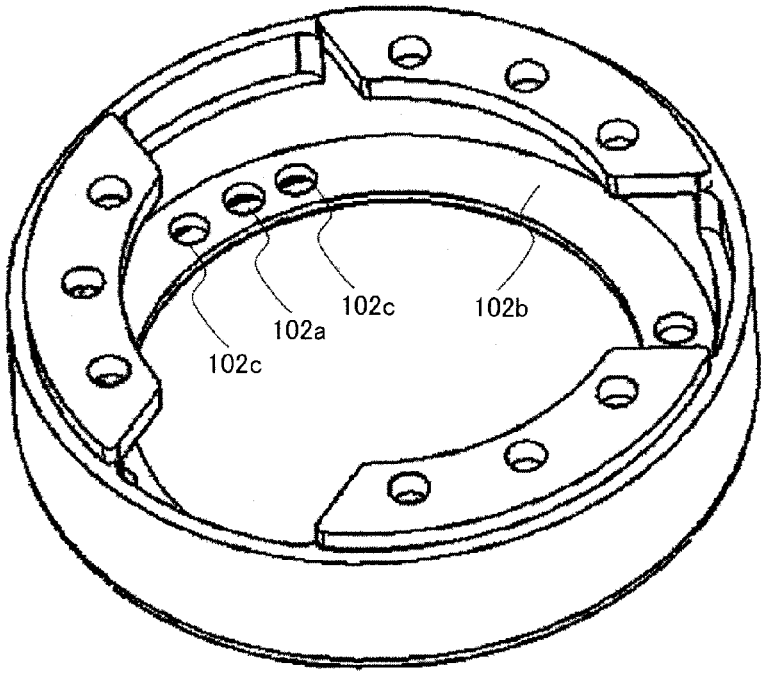
FIG. 10 is a perspective diagram illustrating a moving side main contact in FIG. 9.

Note that the moving side main contact 102 may have a configuration as shown in FIG. 10. In this configuration, the above-described part where the pressing metal fitting 103 of moving side main contact 102 is fastened is cut and the pressing metal fitting 103 is fitted in the part.

Figure 9:
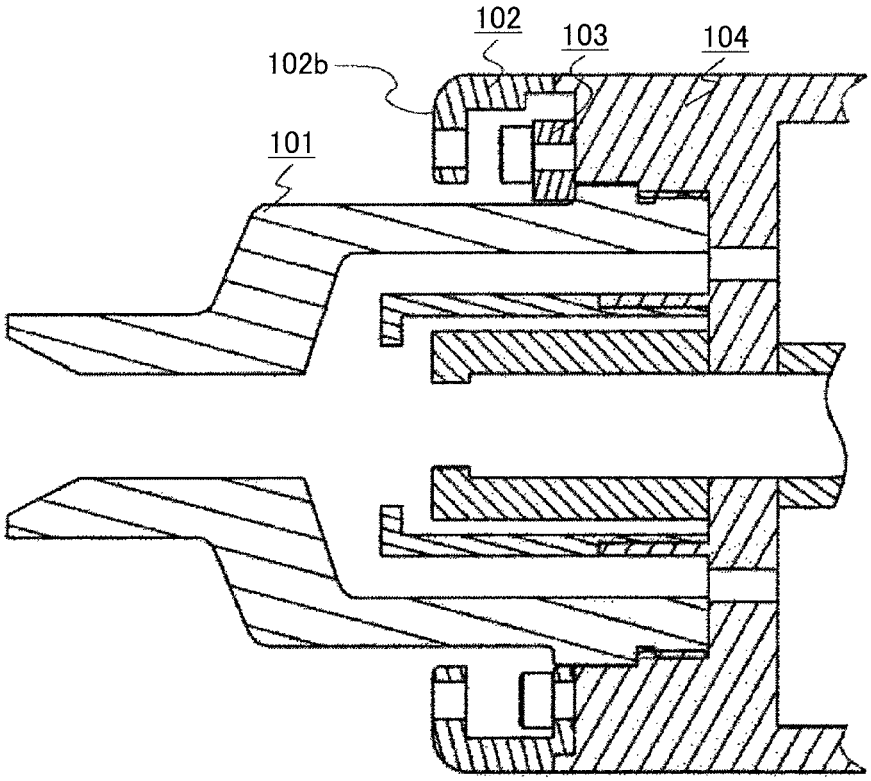
FIG. 9 is a cross-sectional diagram showing a modification of the embodiment 1.

With this configuration, as shown in FIG. 9, it is possible to engage the insulating nozzle 101 while directly fastening the fitting 103 to the cylindrical member 104*a* of the puffer cylinder 104. With this configuration, it is possible to achieve lightweighting of the moving side main contact 102 generally formed with a chromium-copper alloy as a main component and to reduce the weight on the moving side. Accordingly, it is possible to contribute to improvement in breaking speed.

Embodiment 2

Hereinbelow, an embodiment 2 will be described based on FIGS. 11 and 12. Note that the same constituent elements as those in the embodiment 1 have the same reference numerals and the explanations of the elements will be omitted.

Figure 11:
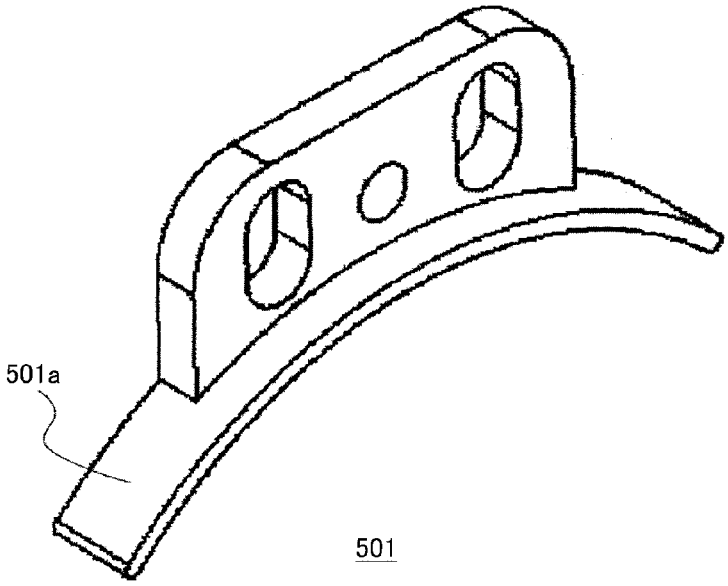
FIG. 11 is a perspective diagram illustrating the pressing metal fitting used for fixing the insulating nozzle according to an embodiment 2 of the present invention.
Figure 12:
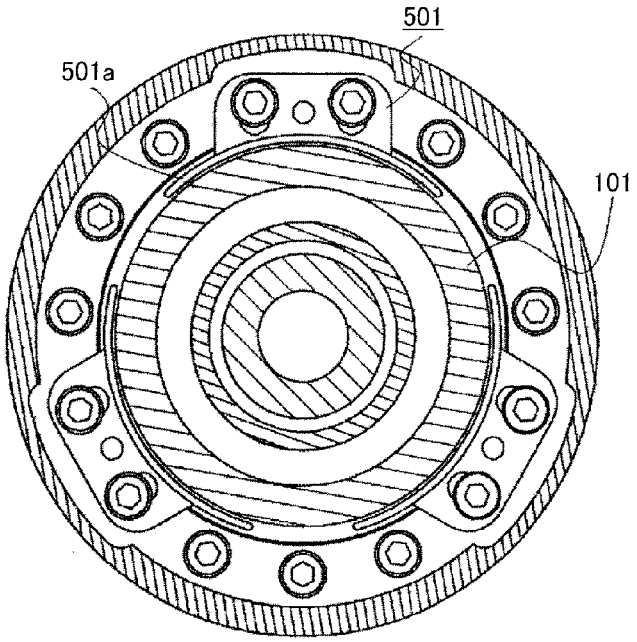
FIG. 12 is a cross-sectional diagram of the insulating nozzle fixing structure to which the pressing metal fitting in FIG. 11 is applied.

The characteristic feature of the present embodiment resides in that a pressing metal fitting 501 shown in FIG. 11 is applied in place of the pressing metal fitting 103 in the embodiment 1. The pressing metal fitting 501 has a circular member 501*a*, projecting in a position where the nozzle large diameter member 101*b* is engaged, along the outer peripheral direction of the nozzle.

The other points are the same as those in the pressing metal fitting 103 according to the embodiment 1, and the attachment/removal work procedure is the same. FIG. 12 shows a configuration after attachment of the pressing metal fitting 501.

As it is understood from this figure, in comparison with the embodiment 1, it is possible to more stably hold and engage the insulating nozzle 101, and the reliability of the circuit breaker is improved.

Embodiment 3

Figure 13:
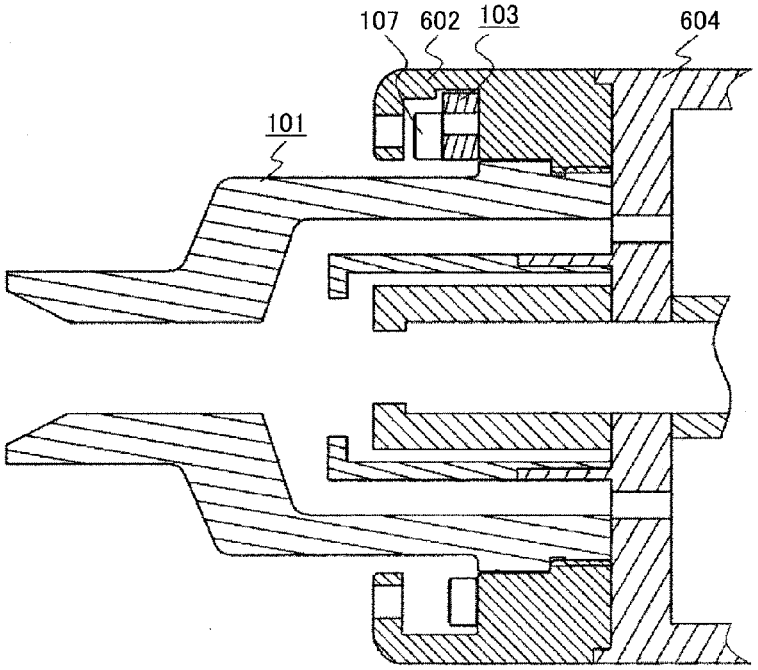
FIG. 13 is a cross-sectional diagram illustrating the insulating nozzle fixing structure according to an embodiment 3 of the present invention.

Hereinbelow, the embodiment 3 will be described based on FIG. 13. The same constituent elements as those in the embodiment 1 have the same reference numerals and the explanations of the elements will be omitted.

In the embodiment 1, the insulating nozzle 101 is screwed and fixed in the inner peripheral surface of the cylindrical member 104*a* of the puffer cylinder 104. On the other hand, in the present embodiment, the insulating nozzle is screwed and fixed in the inner peripheral surface of a moving side main contact 602.

The moving side main contact 602 is fixed, along with the pressing metal fitting 103, to the breaker part side end of a puffer cylinder 604 with a pressing metal fitting fixing bolt

107 (longer than that in the embodiment 1). The other points are the same as those in the embodiment 1, and the attachment/removable work procedure is the same as that in the embodiment 1. With this configuration, it is not necessary to provide a cylindrical member at the breaker part side end of the puffer cylinder. Accordingly, it is possible to perform process with ease.

Note that it is possible to apply the pressing metal fitting 501 having a configuration shown in the embodiment 2 to the embodiment 3.

REFERENCE SIGNS LIST

101 Insulating nozzle
101*a* Insulating nozzle screw member
101*b* Insulating nozzle large diameter member
102 Moving side main contact
102*a* Pressing metal fitting regulating hole
102*b* Moving side main contact shield
103 Pressing metal fitting
103*a* Pressing metal fitting positioning hole
103*b* Screw engagement long hole
103*c* Engagement member
104 Puffer cylinder
104*a* Cylindrical member
105 Moving side arc contact
106 Insulating cover
107 Pressing metal fitting fixing bolt
108 Moving side main contact fixing bolt
109 Moving side conductor
110 Puffer piston
111 Puffer shaft
112 Insulating rod (closer to operating mechanism unit)
201 Insulating tank
202 Fixed side conductor
203 Fixed side arc contact base
204 Fixed side arc contact
205 Fixed side main contact
401 pressing metal fitting positioning jig
501 pressing metal fitting (embodiment 2)
501*a* pressing metal fitting circular member (embodiment 2)
602 Moving side main contact (embodiment 3)
604 puffer cylinder (embodiment 3)

The invention claimed is:

1. A gas circuit breaker comprising:
a tank filled with an arc extinguishing gas;
a fixed side arc contact and moving side arc contact in the tank;
a puffer chamber formed with a puffer cylinder including the moving side arc contact at an end and a fixed piston; and
an insulating nozzle, attached to the end of the puffer cylinder, surrounding the moving side arc contact, that forms a flow channel to guide the arc extinguishing gas from the puffer chamber to the contacts,
wherein the arc extinguishing gas in the puffer chamber is compressed in accordance with opening operation of the contacts and blown to an arc between the contacts,
wherein the puffer cylinder has a cylindrical member at a breaker part side end,
wherein an end of the insulating nozzle is provided in the cylindrical member, and
further comprising:
a hollow moving side main contact at a breaker part side end of the cylindrical member; and
an engagement member that engages the insulating nozzle in a hollow part of the moving side main contact, and
wherein the engagement member has a long hole in which a position of the engagement member in the hollow part is adjustable in a diameter direction of the insulating nozzle.

2. The gas circuit breaker according to claim 1, wherein the engagement member has a positioning hole,
wherein the moving side main contact has a position regulating hole for the engagement member, and
wherein a positioning jig is inserted in the positioning hole through the position regulating hole, and the position of the engagement member is adjusted in the diameter direction of the insulating nozzle.

3. The gas circuit breaker according to claim 1, wherein the engagement member is fixed to an end of the cylindrical member in a position different from that of the moving side main contact.

4. The gas circuit breaker according to claim 3, wherein the engagement member has a positioning hole,
wherein the moving side main contact has a position regulating hole for the engagement member, and
wherein a positioning jig is inserted in the positioning hole through the position regulating hole, and the position of the engagement member is adjusted in the diameter direction of the insulating nozzle.

5. The gas circuit breaker according to claim 3, wherein the engagement member has a circular member on an inner diameter side that fixes an outer periphery of the insulating nozzle.

6. The gas circuit breaker according to claim 1, wherein the engagement member is fastened along with the moving side main contact to an end of a cylindrical member of the puffer cylinder with a bolt.

7. The gas circuit breaker according to claim 6, wherein the engagement member has a circular member on an inner diameter side that fixes an outer periphery of the insulating nozzle.

8. The gas circuit breaker according to claim 6, wherein the engagement member has a positioning hole,
wherein the moving side main contact has a position regulating hole for the engagement member, and
wherein a positioning jig is inserted in the positioning hole through the position regulating hole, and the position of the engagement member is adjusted in the diameter direction of the insulating nozzle.

9. The gas circuit breaker according to claim 1, wherein the engagement member has a circular member on an inner diameter side that fixes an outer periphery of the insulating nozzle.

10. A gas circuit breaker comprising:
a tank filled with an arc extinguishing gas;
a fixed side arc contact and moving side arc contact in the tank;
a puffer chamber formed with a puffer cylinder including the moving side arc contact at an end and a fixed piston; and
an insulating nozzle, attached to the end of the puffer cylinder, surrounding the moving side arc contact, that forms a flow channel to guide the arc extinguishing gas from the puffer chamber to the contacts,
wherein the arc extinguishing gas in the puffer chamber is compressed in accordance with opening operation of the contacts and blown to an arc between the contacts,
wherein a hollow cylindrical moving side main contact is provided at a breaker part side end of the puffer cylinder,
wherein a hollow part is provided at a breaker part side end of the hollow cylindrical moving side main contact, wherein an end of the insulating nozzle is disposed in the hollow cylindrical moving side main contact, wherein the hollow part of the moving side main contact has an engagement member that engages the insulating nozzle, and wherein the engagement member has a long hole in which a position of the engagement member in the hollow part is adjustable in a diameter direction of the insulating nozzle.

* * * * *